US006112414A

United States Patent [19]

Andis et al.

[11] Patent Number: 6,112,414

[45] Date of Patent: Sep. 5, 2000

[54] RECHARGEABLE HAIR CLIPPER ASSEMBLY

[75] Inventors: Matthew L. Andis; Robert E. Derby, both of Racine; John M. Piwaron, Milwaukee, all of Wis.

[73] Assignee: Andis Company, Racine, Wis.

[21] Appl. No.: 09/150,411

[22] Filed: Sep. 9, 1998

Related U.S. Application Data

[60] Provisional application No. 60/058,358, Sep. 10, 1997.

[51] Int. Cl.[7] ..... B26B 19/06; B26B 19/38

[52] U.S. Cl. ..... 30/231; 30/34.05; 30/537; 30/DIG. 1; 320/115

[58] Field of Search ..... 30/231, 296.1, 30/537, DIG. 1, 216, 34.05, 298.4; 320/115, 128

[56] References Cited

U.S. PATENT DOCUMENTS

| | | | |
|---|---|---|---|
| 3,283,185 | 11/1966 | Somers et al. | 30/34.05 |
| 3,359,635 | 12/1967 | Jepson et al. | 30/43.92 |
| 5,088,200 | 2/1992 | Piwaron et al. | 30/216 |
| 5,092,048 | 3/1992 | Sukow et al. | 30/210 |
| 5,138,245 | 8/1992 | Mattinger et al. | 320/115 |
| 5,230,153 | 7/1993 | Andis | 30/216 |
| 5,318,356 | 6/1994 | Shelton | 30/537 |
| 5,325,590 | 7/1994 | Andis et al. | 30/216 |
| 5,604,985 | 2/1997 | Andis et al. | 30/132 |

*Primary Examiner*—Hwei-Slu Payer
*Attorney, Agent, or Firm*—Michael Best & Friedrich LLP

[57] ABSTRACT

A hand-held beauty appliance assembly comprising a hand-held beauty appliance and a battery charger. The hand-held beauty appliance includes an appliance housing portion including a rechargeable battery socket having therein a keyway groove, a frame fixedly supported within the appliance housing portion, an electrical motor fixedly supported on the frame, and a pair of electrical terminals connected to the electrical motor and fixedly supported on the frame. The hand-held appliance also includes a rechargeable battery portion insertable into the battery socket and including a pair of electrical terminals in engagement with the pair of electrical terminals of the appliance housing portion when the rechargeable battery portion is located in the battery socket. The battery portion also includes a keyway slot, a key removably receivable in the keyway groove, a plurality of exterior electrical contacts, and an battery assembly electrically connected to the electrical terminals and to less than all of the plurality electrical contacts.

21 Claims, 9 Drawing Sheets

351
T1
D1
D2
D3
D4
120VAC
60HZ
353
LED 1
R3
Q1
R7
R10
Q3
C1
Z D1
C3
355
LED 2
581
R6
293
232
192
D8
D9
D10
271
Q4
194
234
583
FET 1
Q5
Q6
Q7
S
IC1
IC2
IC3
357
359
361
261

RECHARGEABLE HAIR CLIPPER ASSEMBLY

RELATED APPLICATION

This is a continuing application of provisional application Ser. No. 60/058,358, filed Sep. 10, 1997.

Attention is also directed to U.S. Application Ser. No. 08/895,803, filed Jul. 17, 1997 and entitled: Hair Clipper With Resiliently Removable Cover Portion Enclosing A Blade Drive Assembly.

BACKGROUND OF THE INVENTION

The invention relates generally to hand-held beauty appliances, such as hair clippers, and, more particularly, to rechargeable hair clippers including one or more rechargeable batteries. Still more particularly, the invention particularly relates to hand held rechargeable hair clippers including one or more batteries and to battery recharging devices for the batteries in the hand held clipper.

Attention is directed to the following U.S. Patents:

Piwaron et al. U.S. Pat. No. 5,088,200 issued Feb. 18, 1992

Sukow et al. U.S. Pat. No. 5,092,048 issued Mar. 3, 1992

Andis U.S. Pat. No. 5,230,153 issued Jul. 27, 1993

Andis et al. U.S. Pat. No. 5,325,590 issued Jul. 5, 1994

Andis et al. U.S. Pat. No. 5,604,985 issued Feb. 25, 1997

SUMMARY OF THE INVENTION

The invention provides an appliance assembly comprising an appliance portion including an elongated appliance housing including a rear end portion including a rechargeable battery socket with a transverse base wall having therein a circular aperture, and an interior wall extending from the base wall in the direction of elongation of the appliance housing and having therein a keyway groove extending in the direction of elongation of the appliance housing, a frame fixedly supported within the appliance housing, an electrical motor fixedly supported on the frame within the appliance housing, a pair of electrical terminals fixedly supported on the frame and in spaced relation to each other, and an electrical switch supported by the appliance housing and operatively connected between the electrical terminals and the electrical motor, and a rechargeable battery portion including a sealed housing having an inner end portion removably insertable into the battery socket of the rear end portion of the appliance housing and including a pair of electrical terminals fixed in spaced relation to each other and in engagement with the pair of electrical terminals of the appliance portion when the inner end portion of the sealed housing of the rechargeable battery portion is located in the battery socket, an outer end portion including an end surface, an outer surface extending from the end surface in the direction of insertion of the rechargeable battery portion and having therein a keyway slot extending in the direction of insertion of the rechargeable battery portion, and a plurality of electrical contacts on the outer end portion and in a predetermined spaced relation to one another, and an intermediate portion located between the inner end portion and the outer end portion and having an outer surface including a key extending in the direction of insertion of the battery portion and removably receivable in the keyway groove in the interior wall of the battery socket of the rear end portion of the appliance housing, and a battery assembly located in the sealed housing and electrically connected between the pair of electrical terminals of the inner end portion of the rechargeable battery portion and to less than all of the plurality contacts of the outer end portion of the rechargeable battery portion, and a battery charger including a charger housing including a socket well removably receiving the outer end portion of the rechargeable battery portion and having a generally horizontally extending base wall, and a generally vertical wall extending from the base wall of the socket well, a vertically extending rib extending from the vertical wall and inwardly into the socket well and in engagement with the keyway slot of the outer surface of the outer end portion of the rechargeable battery portion when the outer end portion of the rechargeable battery portion is received in the socket well of the charger housing of the battery charger, a plurality of electrical contacts located in the socket well in a predetermined relation to one another which is the same as the predetermined relation of the plurality of contacts of the outer end portion of the rechargeable battery portion and in respective engagement with the plurality of contacts of the outer end portion of the rechargeable battery portion when the rechargeable battery portion is located in the socket well, an electrical cord extending from the charger housing and being adapted to be connected to a source of electrical current, and a circuit board located within the charger housing and including a circuit electrically connected to the electrical cord and to less than all of the plurality of contacts located on the vertically extending wall of the socket well of the battery charger.

The invention also provides an appliance assembly including an appliance portion including an elongated appliance housing including an outer surface, a rear end portion including a rechargeable battery socket with a transverse base wall having therein a circular aperture, and an interior wall extending from the base wall in the direction of elongation of the housing appliance and having therein a keyway groove extending in the direction of elongation of the appliance housing, an interior annular groove located in axially adjacently spaced relation from the base wall, and an opening communicating between the annular groove and the outer surface of the appliance housing, a locking ring located in the annular groove and including a ring portion defining a bore and including a locking segment, and an operating portion located in diametrically opposed relation from the locking segment and extending radially from the ring portion through the opening communicating between the annular groove and the outer surface of the appliance housing, a frame fixedly supported within the appliance housing, an electrical motor fixedly supported on the frame within the appliance housing, a pair of electrical terminals fixedly supported on the frame and extending in spaced relation to each other, an electrical switch supported by the appliance housing and operatively connected between the electrical terminals and the electrical motor, and a spring located in the annular groove and biasing the locking ring to normally locate the locking segment inwardly beyond the bore of the circular aperture in a locking position and to normally locate the operating portion in outwardly projecting relation to the outer surface and to permit displacement of the locking ring so as to depress the operating portion relative to the outwardly projecting relation and so as to displace the locking segment from the locking position and into a release position clear of the circular aperture, a rechargeable battery portion including a sealed housing having an inner end portion removably receivable in the battery socket of the rear end portion of the appliance housing and including a flange having a periphery, an annular locking groove located axially inwardly from the flange and being lockingly engaged by the locking segment of the locking ring when the inner end portion of the sealed housing of the rechargeable battery portion is located in the battery socket of the rear end portion of the appliance housing of the appliance portion, and when the locking ring is in the locking position, and a pair of electrical terminals located in fixed relation to each other and in engagement with the pair of electrical terminals on the frame when the inner end portion of the sealed housing of the rechargeable battery portion is located in the battery socket, an outer end portion including an end surface, an outer surface extending in the direction of insertion of the rechargeable battery portion and having therein a keyway slot extending in the direction of insertion of the rechargeable battery portion, and a plurality of electrical contacts located on the outer end portion and in spaced relation to one another, and an intermediate portion located between the inner end portion and the outer end portion and having an outer surface extending between the locking groove and the outer surface of the outer end portion and including a key extending in the direction of insertion of the rechargeable battery portion and being removably receivable in the keyway groove in the interior wall of the battery socket of the rear end portion of the appliance housing, and a battery assembly located in the sealed housing and electrically connected between the pair of electrical terminals of the inner end portion of the rechargeable battery portion and the plurality of contacts of the outer end portion of the rechargeable battery portion, and a battery charger including a charger housing including a socket well removably receiving the outer end portion of the rechargeable battery portion and having a generally horizontally extending base wall, and a generally vertical wall extending from the base wall of the socket well, a rib extending inwardly into the socket well and into removable engagement with the keyway slot of the outer surface of the outer end portion of the rechargeable battery portion when the outer end portion of the rechargeable battery portion is received in the socket well of the charger housing of the battery charger, a plurality of electrical contacts located in the socket well and in spaced relation to one another and in respective engagement with the plurality of contacts on the outer end portion of the rechargeable battery portion when the rechargeable battery portion is located in the socket well, an electrical cord extending from the charger housing and being adapted to be connected to a source of electrical current, and a circuit board located within the charger housing and including a circuit electrically connected between the electrical cord and the plurality of contacts in the socket well of the battery charger.

The invention also provides a hair clipper assembly comprising a hair clipper including a clipper portion including an elongated clipper housing assembly including a first half-section, a second half-section mating with the first half-section, an outer surface, a rear end portion defined by the first and second half-sections and including a rechargeable battery socket of non-circular cross-sectional configuration and with a transverse base wall having therein a circular aperture, and an interior wall extending from the base wall in the direction of elongation of the clipper housing assembly and having therein a keyway groove extending in the direction of elongation of the clipper housing assembly, an interior annular groove located in axially adjacently spaced relation from the base wall, and an opening communicating between the annular groove and the outer surface of the first half-section of the clipper housing assembly, a front end portion, and an intermediate portion defining an interior cavity and including interior wall surfaces, a locking ring located in the annular groove and including a ring portion defining a bore and including a locking segment, and an operating portion located in diametrically opposed relation from the locking segment and extending radially from the ring portion through the opening communicating between the annular groove and the outer surface of the first half-section of the clipper housing assembly, a blade set carried by the front end portion of the clipper housing assembly, a frame fixedly supported within the clipper housing assembly by the interior wall surfaces, an electrical motor fixedly supported on the frame within the clipper housing assembly and drivingly connected to the blade set, a pair of electrical terminals fixedly supported on the frame and extending in spaced parallel relation to each other and through the circular aperture into the battery socket, an electrical switch supported by the first half-section of the clipper housing assembly and operatively connected between the electrical terminals and the electrical motor, and a spring biasing the locking ring so as to normally locate the operating portion in outwardly projecting relation to the outer surface, and so as to normally locate the locking segment inwardly within the circular aperture in a locking position, thereby permitting inward displacement of the operating portion from the outwardly projecting relation and displacement of the locking segment from the locking position and into a release position clear of the circular aperture, a rechargeable battery portion including a sealed housing having a battery assembly located in the sealed housing and electrically connected between the pair of electrical terminals extending from the inner end portion and the plurality contacts located adjacent the end surface of the outer end portion, a circular inner end portion removably receivable in the battery socket of the rear end portion of the clipper housing assembly of the hair clipper portion and including a flange defining an inner end of the inner end portion and having a periphery, an annular locking groove located axially inwardly from the flange and being lockingly engaged by the locking segment of the locking ring when the inner end portion of the sealed housing of the rechargeable battery portion is located in the battery socket of the rear end portion of the clipper housing assembly, and when the locking ring is in the locking position, and a pair of electrical terminals extending in spaced parallel relation to each other within the periphery of the flange, in electrical connection with the battery assembly, and in engagement with the pair of electrical terminals extending through the circular aperture into the battery socket when the inner end portion of the sealed housing of the rechargeable battery portion is located in the battery socket, an outer end portion including a dome-shaped end surface, an outer surface having a generally cylindrical cross-sectional configuration, extending from the end surface, and having therein an axially extending keyway slot, and four electrical contacts located adjacent the end surface and in a circular array in evenly spaced arcuate relation to one another and including two of the four contacts in electrical connection with the battery assembly and with the pair of electrical terminals extending from the inner end portion of the rechargeable battery portion, and at least one of the four contacts being electrically unconnected, and an intermediate portion located between the inner end portion and the outer end portion and having an outer surface of non-circular cross-section corresponding to the non-circular cross-section of the socket well of the rear end portion of the clipper housing assembly and extending from the locking groove and to the circular outer surface of the outer end portion of the rechargeable battery portion and including an axially extending key removably receivable in the keyway groove in the axially extending interior wall of the battery socket of the rear end portion of the clipper housing assembly of the hair clipper portion, and a battery charger including a charger housing including a socket well removably receiving the outer end portion of the rechargeable battery portion and having a generally horizontally extending base, and a generally vertically extending cylindrical wall having a generally cylindrical cross-sectional configuration corresponding to the cylindrical cross-sectional configuration of the outer surface of the outer end of the rechargeable battery portion, a vertically extending rib extending from the vertically extending cylindrical wall and inwardly into the socket well and in engagement with the axially extending keyway slot of the outer circular surface of the outer end portion of the rechargeable battery portion when the outer end portion of the rechargeable battery portion is received in the socket well of the charger housing of the battery charger, four electrical contacts located on the vertically extending circular wall adjacent the base and in a circular array in evenly spaced arcuate relation to one another, in respective engagement with the plurality of contacts on the outer circular surface of the outer end portion of the rechargeable battery portion when the rechargeable battery portion is located in the socket well, and including at least one of the four contacts located on the vertically extending circular wall being electrically unconnected, an electrical cord extending from the charger housing and being adapted to be connected to a source of electrical current, and a circuit board located within the charger housing and including a circuit electrically connected between the electrical cord and at least two of the four contacts located on the vertically extending circular wall of the socket well of the battery charger.

Other features and advantages of the invention will become apparent to those skilled in the art upon review of the following detailed description, claims and drawings.

Figure 1:
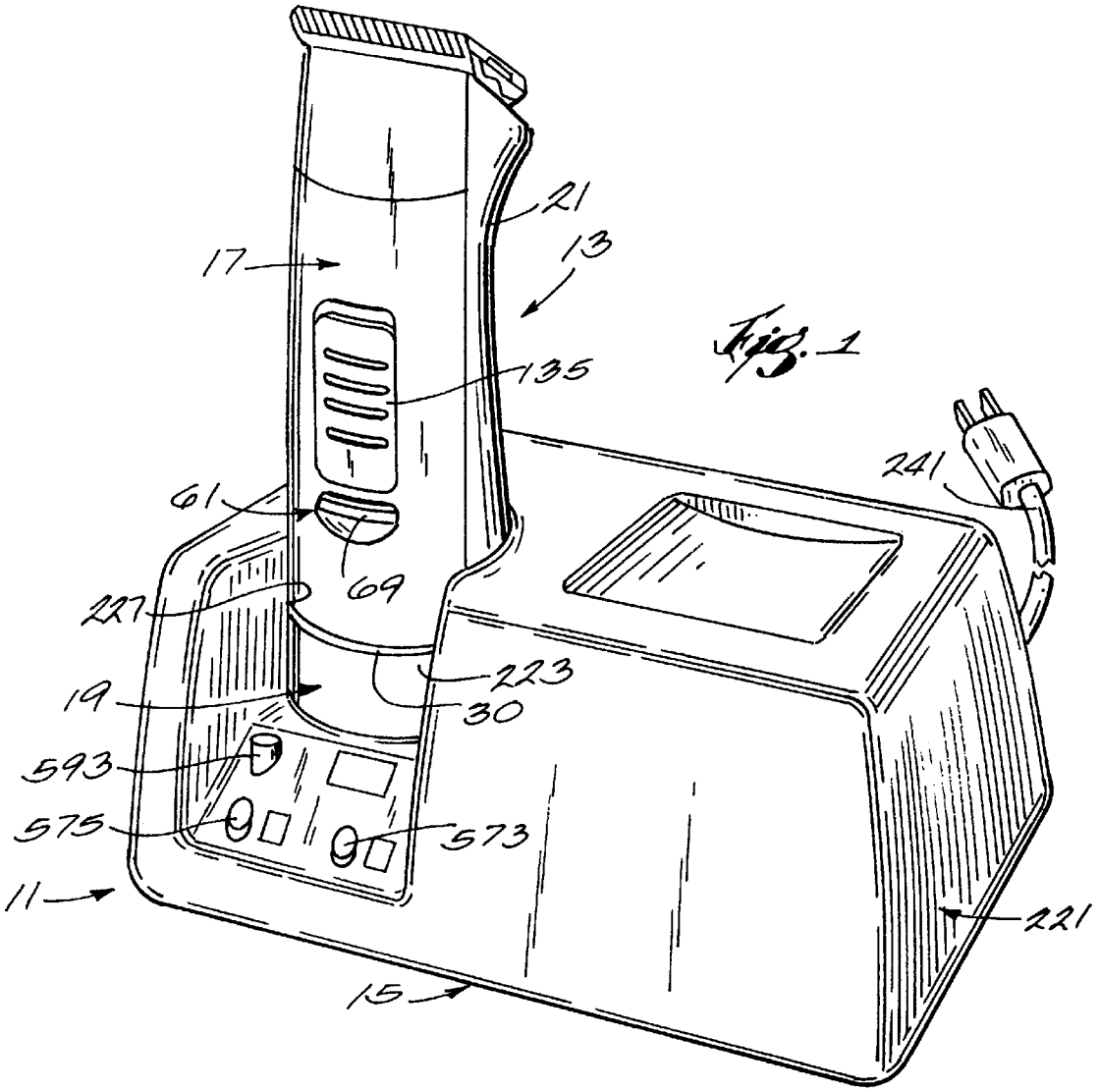
FIG. 1 is a perspective view of one embodiment of a hair clipper assembly which incorporates various of the features of the invention and which includes a rechargeable battery-operated hair clipper and a battery charger.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is understood that the phraseology and terminology used herein is for the purpose of description and should not be regarded as limiting.

DESCRIPTION OF THE PREFERRED EMBODIMENT

Shown in FIG. 1 is a hair clipper assembly 11 which incorporates various of the features of the invention and which includes a rechargeable battery-operated hair clipper 13 and a battery charger 15. In turn, the rechargeable battery-operated hair clipper 13 includes a clipper portion 17 and a rechargeable battery portion 19.

Figure 2:
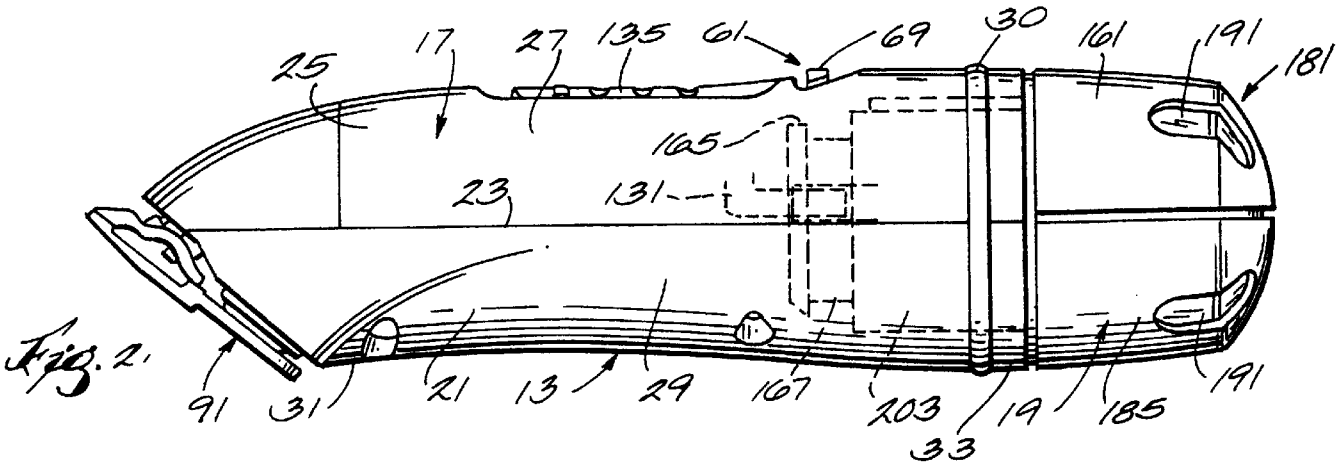
FIG. 2 is a side elevational view of the rechargeable battery-operated hair clipper which is incorporated in the hair clipper assembly shown in FIG. 1.
Figure 3:
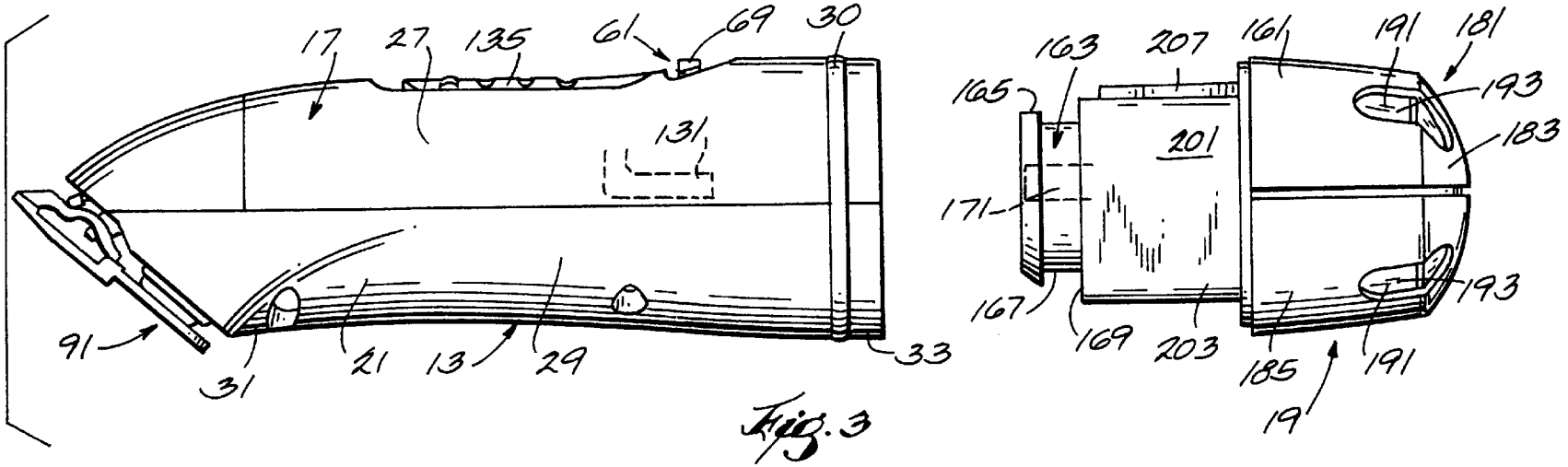
FIG. 3 is an exploded view of the rechargeable battery-operated hair clipper which is shown in FIG. 2 and which illustrates, in spaced relation, a hair clipper portion and a rechargeable battery portion.
Figure 4:
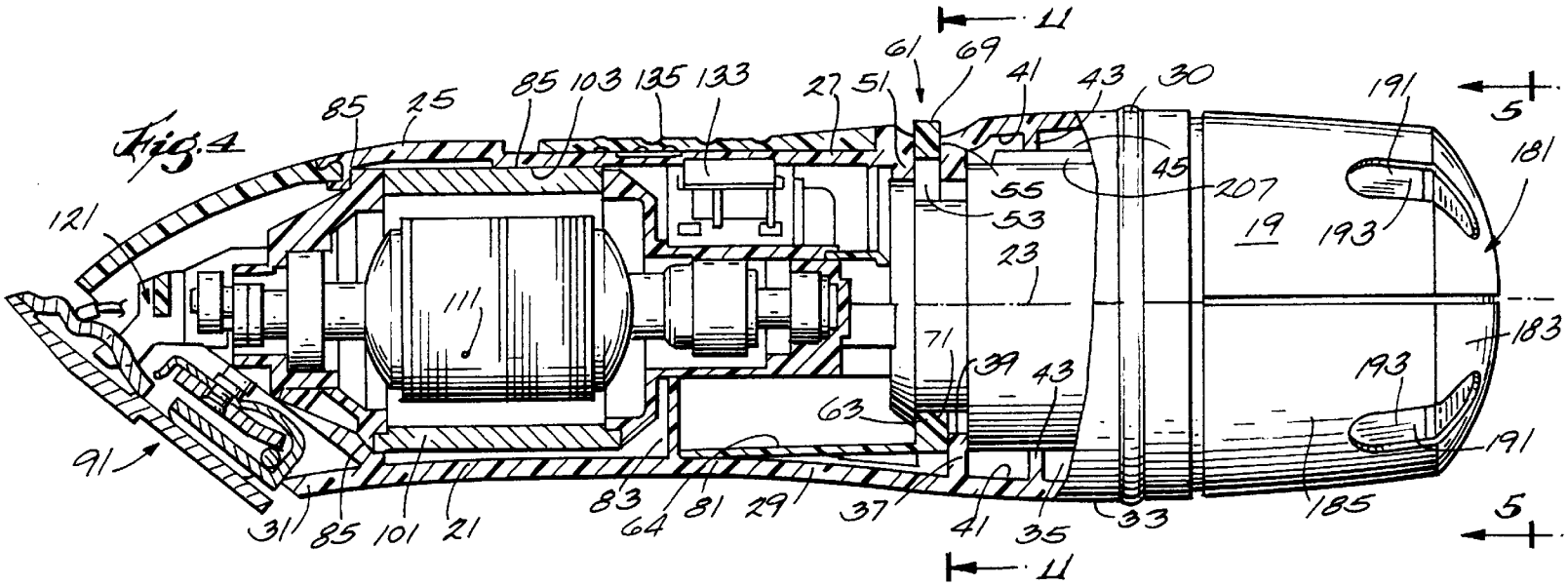
FIG. 4 is an enlarged and partially sectioned view of the rechargeable battery-operated hair clipper which is shown in FIG. 2.

The clipper portion 17 includes (see FIGS. 2, 3, and 4) an elongated clipper housing or housing assembly 21 which includes a forwardly and rearwardly extending axis of elongation 23, and an outer surface 25. While various constructions can be employed, it is preferred that the clipper housing 21 be fabricated from electrically insulating plastic material to include mating upper and lower half-sections 27 and 29 which can be secured or assembled together by any suitable arrangement including screws (not shown). Preferably, the upper and lower half-sections 27 and 29 are also held in assembled relation by an endless resilient O-ring 30 which is located in an annular recess in the outer surface 25 of the rearward portion of the housing assembly 21.

The clipper housing assembly or housing assembly 21 also includes a front end or forward portion 31 and a rear end or rearward portion 33 which includes a battery socket 35 defined by a transverse base wall 37 having therein a circular opening or aperture 39. The battery socket 35 is also defined by an interior wall 41 which extends rearwardly and axially from the base wall 37 and which is preferably of generally cylindrical configuration. In addition, the interior wall 41 is preferably provided with a plurality of axially spaced, transverse ribs 43 which effectively provide the battery socket 35 with a non-circular cross-section transversely of the axis of elongation, which cross-section, in the disclosed construction, is generally square. The interior wall 41 also has therein an axially extending keyway groove 45 which extends through the ribs 43.

The rear end or rearward portion 33 also includes, in axially adjacent and spaced relation to the base wall 37, a radially inwardly extending flange 51 which is centrally apertured and which, together with the base wall 37, defines an interior annular groove 53. In addition, the rear end or rearward end portion 33 also includes, in the upper housing half-section 27, an opening 55 communicating between the annular groove 53 and the outer surface 25 of the clipper housing or housing assembly 21.

Figure 11:
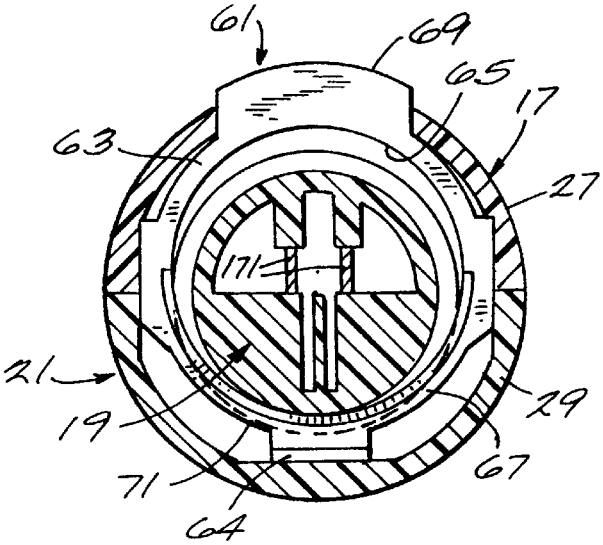
FIG. 11 is a sectional view taken along line 11—11 of FIG. 4.

The rear end or rearward portion 33 of the clipper housing assembly 21 also includes a locking ring 61 which is fabricated, separately from the clipper housing assembly 21, from electrically insulating plastic material, which is located in the annular groove 53 and which includes a ring portion 63 and, preferably, an integrally connected spring portion 64. The ring portion 63 includes (see FIG. 11) a central bore 65, and a locking segment 67, and an operating portion 69 which is located in diametrically opposed relation from the locking segment 67, which extends radially from the ring portion 63 and through the opening 55, and which normally projects from the outer surface 25 of the upper half-section 27 of the clipper housing assembly 21. The locking segment 67 is provided, on the rearwardly facing edge thereof, with an inclined camming surface 71 which extends for approximately 180 degrees and which cooperates with a camming surface still to be described on the rechargeable battery portion 19.

The spring portion 64 biases the locking ring 61 to normally locate the locking segment 67 inwardly beyond the periphery of the circular aperture 39 in a locking position and to normally locate the operating portion 69 in outwardly projecting relation to the outer surface 25 of the upper housing half-section 27 and so as to permit displacement of the locking ring 61 relative to the housing assembly 21 so as to depress the operating portion 69 from the outwardly projecting relation to the upper housing half-section 27 and so as to displace the locking segment 67 from the locking position and into a release position clear of the circular aperture 39.

If desired, the ring portion 63 and the spring portion 64 can be separately fabricated.

The clipper housing assembly 21 also includes (see FIG. 4) an intermediate portion 81 which is located between the front end or forward portion 31 and the rear end or rearward portion 33, which defines an interior cavity 83, and which includes interior wall surfaces 85.

The clipper portion 17 also includes a blade set 91 which can be of any conventional construction and which is suitably mounted on the front end or forward portion 31 of the clipper housing assembly 21 and, more specifically, on the forward end of the lower clipper housing half-section 29.

The clipper portion 17 also includes a frame 101 which is preferably fabricated of electrically insulating plastic material, which is fixedly supported within the clipper housing or housing assembly 21, and which includes wall surfaces 103 engaged by the interior wall surfaces 85 of the intermediate portion 81 of the clipper housing 21 in such manner as to prevent movement of the frame 101 relative to the clipper housing 21 in the direction of elongation of the clipper housing 21 and in all directions transverse to the direction of elongation. If desired, the frame can also be connected to the housing assembly 21 by one or more screws (not shown), or by a combination of screws and engaged surfaces.

The clipper portion 17 also includes an electrical motor 111 which can be of any suitable construction and which is suitably fixedly supported on the frame 101 within the clipper housing assembly 21 and drivingly connected to the blade set 91 through a blade drive assembly 121 which can be of any suitable construction.

Figure 8:
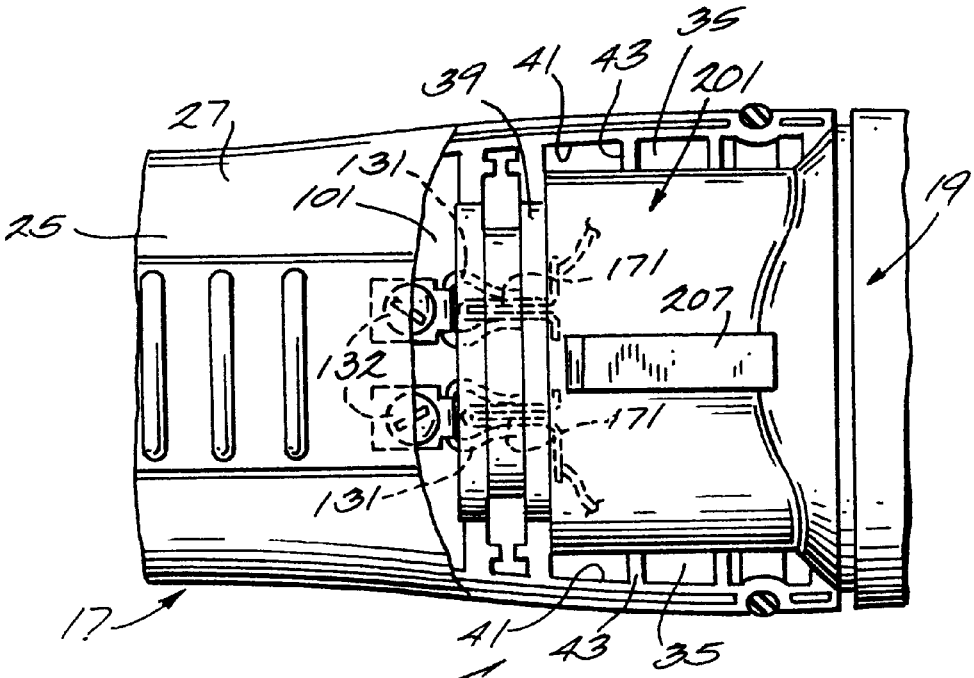
FIG. 8 is a fragmentary view, partially broken-away and in section, of a top portion of a middle part of the rechargeable battery-operated hair clipper shown in FIG. 2.
Figure 9:
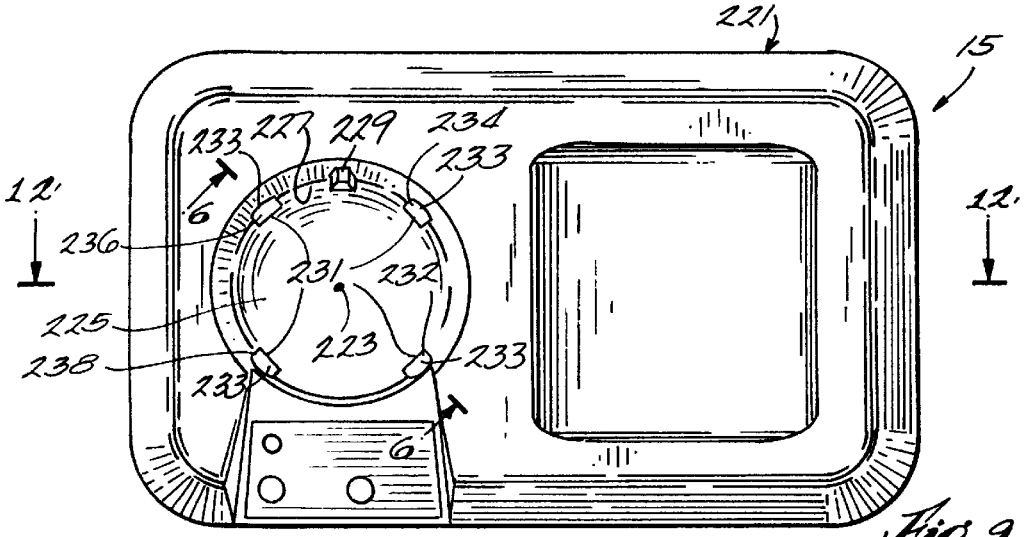
FIG. 9 is a top plan view of the of the battery charger which is incorporated in the hair clipper assembly shown in FIG. 1.
Figure 10:
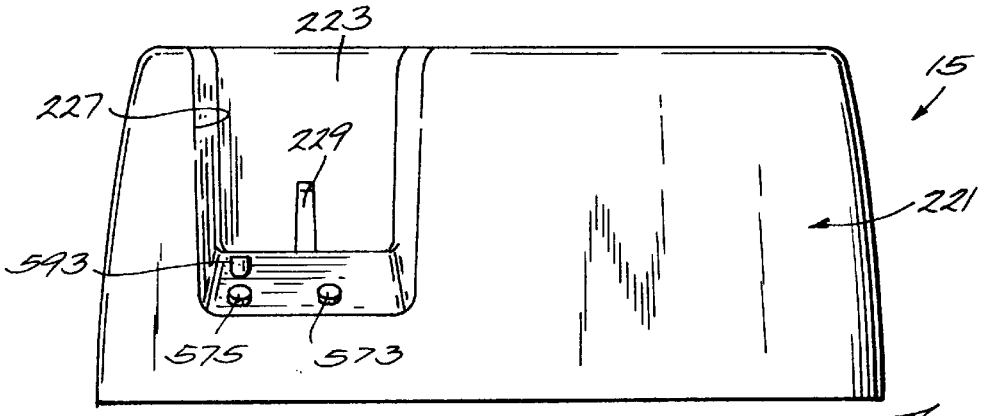
FIG. 10 is a side elevational view of the of the battery charger which is incorporated in the hair clipper assembly shown in FIG. 1.
Figure 12:
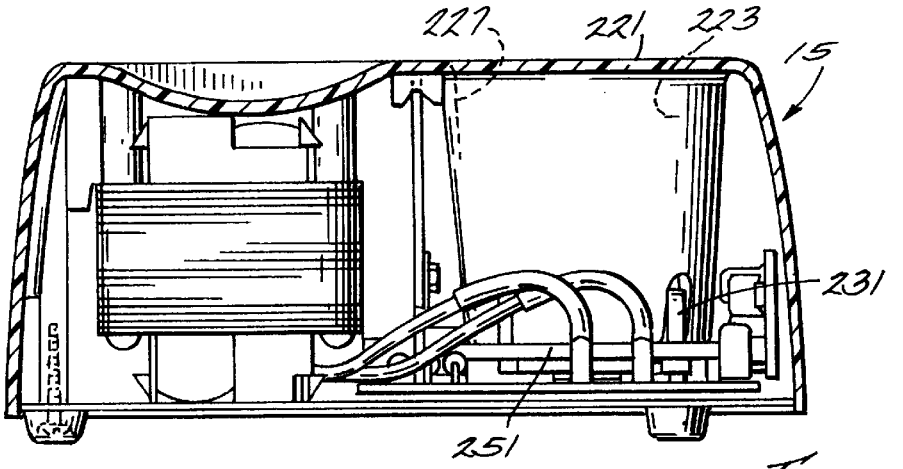
FIG. 12 is a sectional view taken along line 12—12 of FIG. 9.

The clipper portion 17 also includes (see FIG. 8) a pair of electrical terminals 131 which can be of any suitable construction, which are fixedly supported on the frame 101 by any suitable arrangement, such as the disclosed screws 132, and which, in the disclosed construction, include respective unshaped portions extending rearwardly in spaced parallel relation to each other, through the circular aperture 39, and into the battery socket 35.

The clipper portion 17 also includes (see FIG. 4) an electrical off-on switch 133 which can be of any suitable construction, which is suitably supported by the upper housing half-section 27, which includes an axially moveable switch operating member 135, and which is operatively connected between the electrical terminals 131 and the electrical motor 111.

Figure 7:
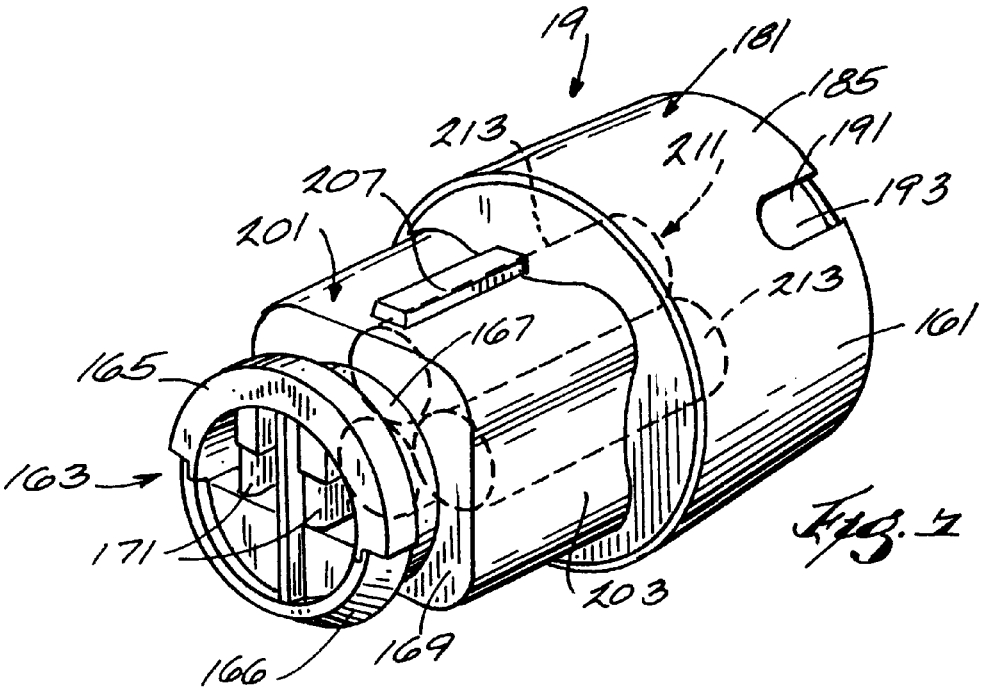
FIG. 7 is a perspective view of the rechargeable battery portion, which view particularly illustrates the inner end of the rechargeable battery portion which is received in the a hair clipper portion.

The rechargeable battery portion 19 includes (see FIGS. 3 and 7) a sealed housing 161 which is preferably fabricated of electrically insulating plastic material in two half segments which are sonically or otherwise welded to each other. The sealed housing includes a circular inner end portion 163 which is removably receivable in the battery socket 35 of the rear end or rearward portion 33 of the clipper housing assembly 21. The circular inner end portion 163 includes an annular flange 165 having a periphery, and an annular locking groove 167 which is located axially rearwardly from the annular flange 165, which is defined by the annular flange 165 and by an adjacent shoulder 169, and which is lockingly engaged by the locking segment 67 of the locking ring 61 when the inner end portion 163 of the sealed housing 161 of the rechargeable battery portion 19 is located in the battery socket 35 of the rear end or rearward portion 33 of the clipper housing assembly 21, and when the locking ring 61 is in the locking position.

The annular flange 165 is provided (see especially FIG. 7) with an inclined camming surface 166 which extends arcuately for approximately 180 degrees along the lower half of the annular flange 165 and which, consequent to insertion of the battery portion 19 into the battery socket 35, engages the camming surface 71 on the locking ring 61 to displace the locking ring 61, against the action of the spring portion 64, to a position permitting insertion of the annular flange 165 inwardly beyond the locking ring 61 and subsequent movement of the locking ring 61 into the locking position in the annular groove 167 in the rechargeable battery portion 19.

The inner end portion 163 of the rechargeable battery portion 19 also includes a pair of electrical terminals 171 extending in spaced parallel relation to each other within the periphery of the annular flange 165 and in engagement with the pair of electrical terminals 131 extending through the circular aperture 39 into the battery socket 35 when the inner end portion 163 of the sealed housing 161 of the rechargeable battery portion 19 is located in the battery socket 35.

Figure 5:
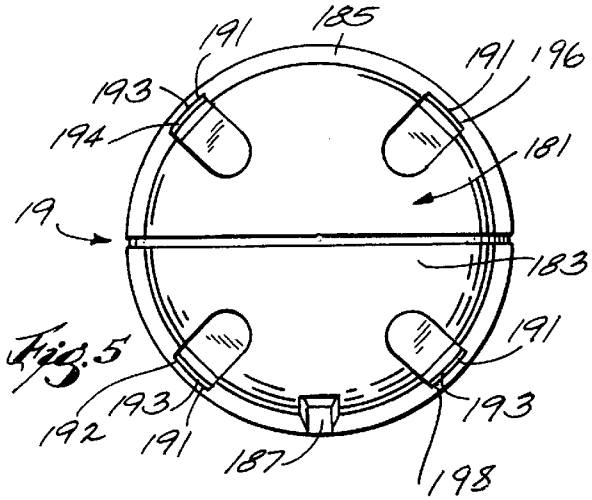
FIG. 5 is an end view taken along line 5—5 of FIG. 4.

The rechargeable battery portion 19 also includes an outer end portion 181 including a dome-shaped end surface 183, an outer generally cylindrical or slightly tapered surface or wall 185 extending axially inwardly from the dome-shaped end surface 183. The outer end portion 181 also includes (see FIG. 5) an axially extending keyway slot 187 which cooperates with the battery charger 15 as will be disclosed.

Figure 6:
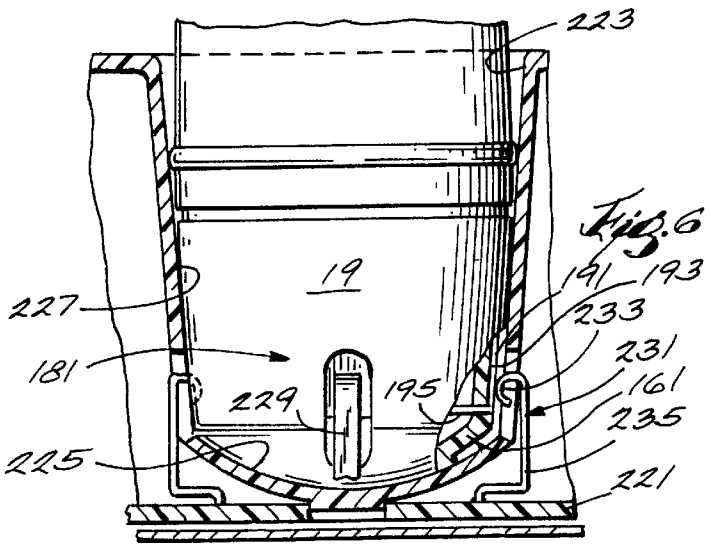
FIG. 6 is a fragmentary view, partially in section, illustrating receipt of the rechargeable battery portion shown in FIG. 3 in the battery charger shown in FIG. 1.

The outer end portion 181 also includes a plurality of electrical contacts 191 which are arranged in a circular array in evenly spaced arcuate relation to one another and adjacent the dome-shaped end surface 181. The electrical contacts 191 include respective outer portions 193 located in slightly depressed relation to the cylindrical surface or wall 185 and (see FIG. 6) respective inner portions 195 extending into the interior of the sealed housing 161 for electrical connection as will be disclosed. While other constructions can be employed, in the specifically disclosed construction, the electrical contacts 191 are four in number and include (see FIG. 5) first, second, third, and fourth contacts 192, 194, 196, and 198.

The rechargeable battery portion 19 also includes an intermediate portion 201 located between the inner end portion 163 and the outer end portion 181 and having a non-circular outer surface 203 which, preferably, is generally square, which extends from the locking groove 167 or shoulder 169 and to the outer end portion 181, and which mates with the non-circular cross-section of the interior wall 41 of the battery socket 35 to stabilize the sealed housing 161 in the battery socket 35.

In addition, the non-circular outer surface 203 of the intermediate portion 201 includes an axially extending key 207 removably receivable in the keyway groove 45 in the axially extending interior wall 41 of the battery socket 35 of the rear end portion 33 of the housing assembly 21 of the clipper portion 17. In addition, receipt of the key 207 in the groove 45 insures correct alignment of the electrical terminals 131 extending from the frame 101 and the electrical terminals 171 extending from the rechargeable battery portion 17 and enables proper engagement between the electrical terminals 131 and 171 incident to insertion of the rechargeable battery portion 19 into the battery socket 35 of the clipper portion 17.

Enclosed in the sealed housing 161 is (see FIG. 13) a battery assembly 211 including a plurality of rechargeable batteries 213 electrically connected to the electrical terminals 171 and 191. Any suitable rechargeable batteries can be employed.

The battery charger 15 includes (see FIGS. 1, 6, 9, 10, 11, and 12) a charger housing 221 which is preferably fabricated of electrically insulating plastic material and which includes a socket well 223 which removably receives the outer end portion 181 of the rechargeable battery portion 19 and which has a generally horizontally extending and concavely shaped base wall 225.

In addition, the socket well 223 of the battery charger 15 also includes a cylindrical or slightly tapered wall 227 which extends generally vertically from the base wall 225, and a vertically extending rib 229 which extends from the vertically extending wall 227 and inwardly into the socket well 223 and into engagement with the axially extending keyway slot 187 (FIG. 5) of the outer surface 185 of the outer end portion 181 of the rechargeable battery portion 19 when the outer end portion 181 of the rechargeable battery portion 19 is received in the socket well 223 of the charger housing 161 of the battery charger 15. Engagement of the rib 229 in the keyway slot 187 serves to properly locate the rechargeable battery portion 19 relative to the batter charger 15.

Still further in addition, the socket well 223 of the battery charger 15 also includes (see FIG. 6) a plurality of electrical contacts 231 which can be of any suitable construction, and which are equal in number to the plurality of contacts 191 on the rechargeable battery portion 19. Thus while other constructions can be employed, in the specifically disclosed construction, the contacts 231 are four in number and comprise (see FIG. 9) first, second, third, and fourth contacts 232, 234, 236, and 238 which, when the rechargeable battery portion is in the socket well 223 of the battery charger 15, respectively engage first, second, third, and fourth contacts 192, 194, 196, and 198.

The electrical contacts 231 respectively include (see FIG. 6) outer portions 233 located within the socket well 223, interiorly of the vertical surface or wall 227, and in a circular array in evenly spaced arcuate relation to one another and adjacent the base wall 225, and in respective engagement with the plurality of contacts 191 on the outer surface 185 of the outer end portion 181 of the rechargeable battery portion 19 when the rechargeable battery portion 19 is located in the socket well 223. In addition, the plurality of contacts 231 include respective inner portions 235 extending into the interior of the charger housing 221 for electrical connection as will be disclosed.

The battery charger 15 includes (see FIG. 1) an electrical cord 241 extending from the charger housing 221 and adapted to be connected to a source of electrical current. In addition, the battery charger 15 also includes (see FIG. 12) a circuit board 251 located within the charger housing 221 and having mounted thereon a battery charging circuit 261 which is shown schematically in FIG. 15, and which is electrically connected between the electrical cord 241 and the plurality of contacts 231 located on the vertically extending cylindrical wall 227 of the socket well 223 of the battery charger 15.

Figure 13:
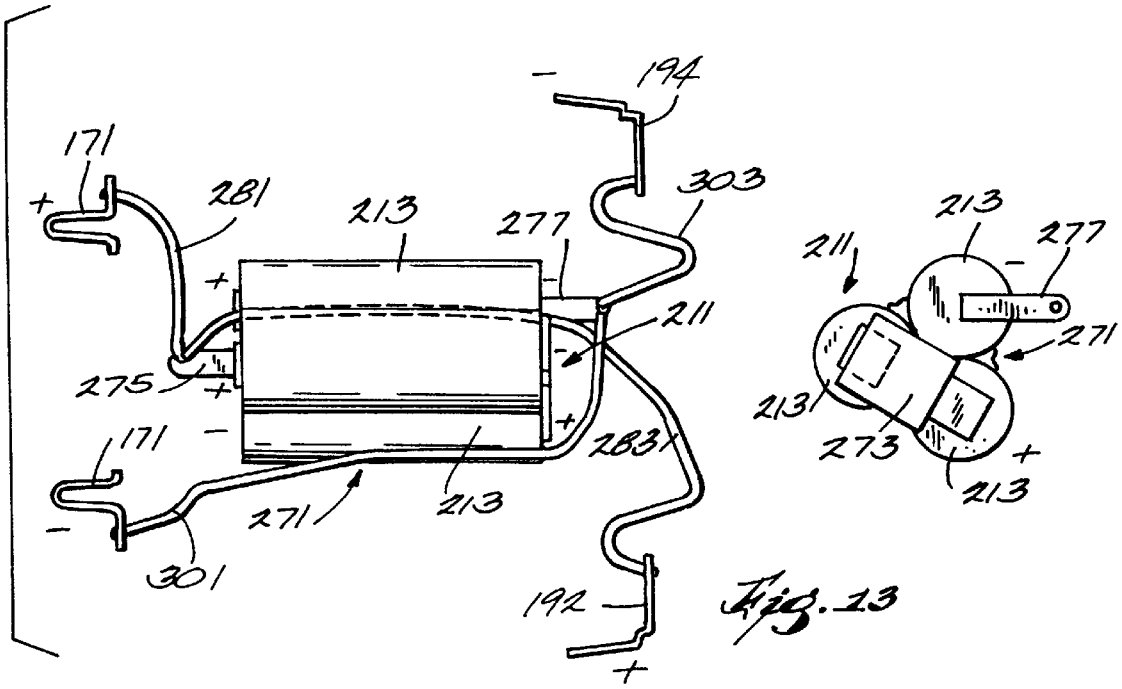
FIG. 13 is an exploded elevational view of a first embodiment of a battery assembly which can be included in the hair clipper shown in FIG. 2.
Figure 14:
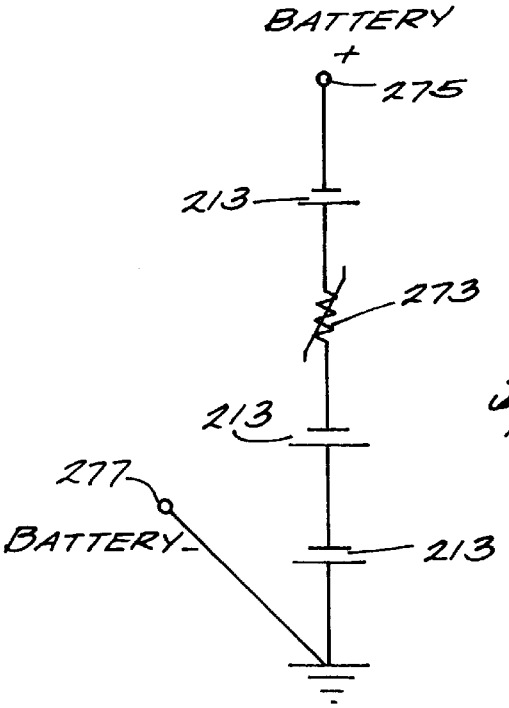
FIG. 14 is a wiring diagram for the battery assembly shown in FIG. 13.
Figure 15:
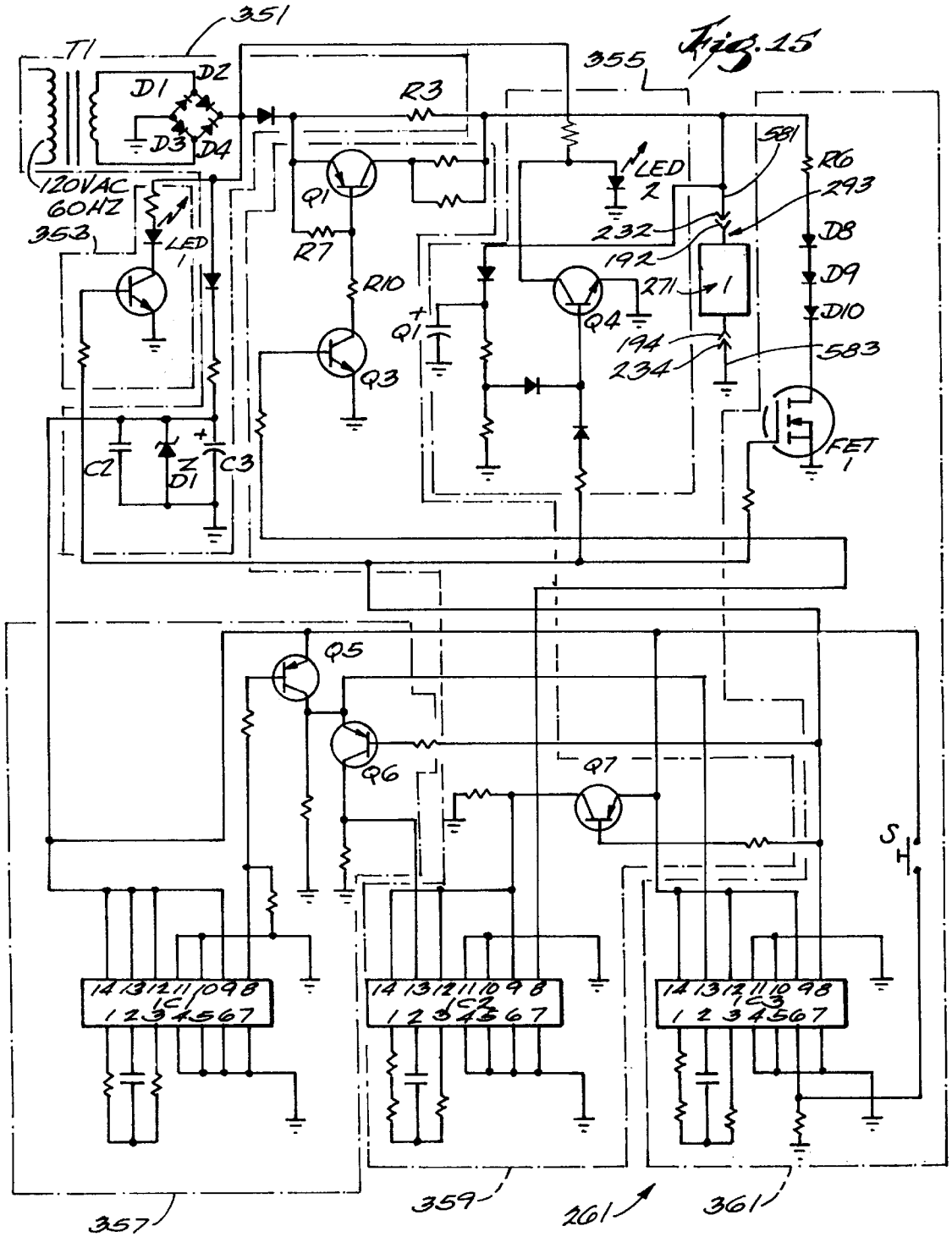
FIG. 15 is a wiring diagram illustrating one embodiment of a circuit which is employed with the battery assembly referred to in FIGS. 13 and 14.

In one particular embodiment, as shown in FIGS. 13, 14 and 15, the battery assembly 211 includes (see FIGS. 13 and 14) three batteries 213 which are nestled together, in any suitable manner, to provide a compact battery pack 271, which are connected together in series with one another and with a suitable polyswitch 273, and which are connected to a positive terminal 275 and to a negative terminal 277. The battery pack 271 also includes a first lead 281 which is connected between the positive terminal 275 and one of the pair of terminals 171 extending from the inner end portion 163 of the rechargeable battery portion 19, and a second lead 283 which extends from the positive terminal 275 to the first contact 192 of the plurality of contacts 191 on the outer end portion 181 of the rechargeable battery portion 19, which first contact 192 engages the first contact 3 of the plurality of contacts 231 in the socket well 223 of the battery charger 15 when the rechargeable battery portion 19 is in the socket well 223 of the battery charger 15.

The battery pack 271 also includes a third lead 301 which is connected between the negative terminal 277 and the other one of the pair of terminals 171 extending from the inner end portion 163 of the rechargeable battery portion 19, and a fourth lead 303 which extends from the negative terminal 277 to the second contact 194 of the plurality of contacts 191 on the outer end portion 181 of the rechargeable battery portion 19, which second contact 194 engages the second contact 234 of the plurality of contacts 231 in the socket well 223 of the battery charger 15 when the rechargeable battery portion 19 is in the socket well 223 of the battery charger 15. The third contact 196 and the fourth contact 198 of the plurality of contacts 191 respectively engage the third contact 236 and the fourth contact 238 of the plurality of contacts 231 in the socket well 223 of the battery charger 15 when the rechargeable battery portion 19 is in the socket well 223 of the battery charger 15 and are electrically unconnected within the rechargeable battery portion 19. In addition, the contacts 236 and 238 are electrically unconnected within the battery charger 15.

The battery charging circuit 261 includes (see FIG. 15), in general terms, a power supply circuit 351, a pair of indicator circuits 353 and 355, a reconfigure/timer circuit 357 a boost charge circuit 359, and a discharge circuit 361. The battery charging circuit 261 operates, in general, to effect full discharge and recharge of the batteries 213.

The power supply circuit 351 is adapted to be connected to an alternating current source of electrical power. In the embodiment shown in FIG. 15, the power supply circuit 351 is connected to a 120 volt, 60 hertz alternating current source of electrical power. The power supply circuit 351 includes a power transformer T1 connected to a full-wave bridge rectifier that converts the alternating current voltage into direct current (d.c.) voltage at 12 volts. The power supply circuit 351 also includes capacitor C2 and C3 for filtering and smoothing the rectified voltage as well as zener diode ZD1 which acts as a shunt regulator to "bleed off" any voltage in excess of 5 volts d.c.

The reconfigure/timer circuit 357 is connected to the power supply circuit 573 and includes an integrated circuit timer IC1. In the embodiment shown in the drawings, the timer IC1 is a Motorola MC14541BCP integrated circuit timer. The reconfigure/timer circuit 357 also includes transistors Q5 and Q6. The timer IC1 is configured to send control signals to the discharge circuit 361 and the boost charge circuit 359 via transistors Q5 and Q6.

The boost charge circuit 359 includes timer IC2 and transistor Q7. In the embodiment shown in FIG. 15, timer IC2 is a Motorola MC14541 BCP integrated circuit timer. The boost charge circuit 359 also includes drive transistors Q1 and Q3 and resistor RIO which form a power switch network that increases the charge current flowing to the batteries 213 in the boost charge operating mode.

The discharge circuit 361 includes timer IC3. In the embodiment shown in FIG. 15, timer IC3 is a Motorola MC14541 BCP integrated circuit timer. Timer IC3 is connected to an off-on switch S (also identified by the numeral 593 in FIG. 1) which is a momentary switch. Timer IC3 is also connected to switch FET1 which is a field effect transistor. The off-on switch S (593) is mounted on the charger housing 221 adjacent to the charging and discharging indicators 573 and 575. Switch FET1 is connected to the power supply circuit 351 via series connected diodes D8, D9 and D10 and resistor R6.

The indicator circuits 353 and 355 respectively include visual indicators LED1 and LED2. In the embodiment shown in FIG. 15, the visual indicators LED1 and LED2 are light emitting diodes. However, any visual or audible indicator may be appropriate under various circumstances. As will be described in greater detail below, visual indicators LED1 and LED2 are lit to indicate the various operating states of the battery charge circuit 261. The visual indicator LED1 is electrically driven by transistor Q2 and the visual indicator LED2 is electrically driven by transistor Q4. More particularly, the light emitting diode LED1 is also identified in FIG. 1 by the numeral 573, is mounted on the charger housing 221, is preferably of one color, such as green, and is illuminated during battery charging. The second light emitting diode LED2 is also identified in FIG. 1 by the numeral 575, is mounted on the charger housing 221 adjacent the charging indicator 573 (LED1), is preferably of another color, such as red, and is illuminated during battery discharging.

As shown in FIG. 15, the battery charging circuit 261 also includes a first lead 581 which is connected to the first contact 232 of the plurality of contacts 231 in the socket well 223, which first contact 232 engages the first contact 192 of the plurality of contacts 191 on the outer end portion 181 of the rechargeable battery portion 19 when the rechargeable battery portion 19 is in the socket well 223 of the battery charger 15. The battery charging circuit 261 also includes a second lead 583 which is connected to the second contact 234 of the plurality of contacts 231 in the socket well 223, which second contact 234 engages the second contact 194 of the plurality of contacts 191 on the outer end portion 181 of the rechargeable battery portion 19 when the rechargeable battery portion 19 is in the socket well 223 of the battery charger 15. The third and fourth contacts 196 and 198 of the plurality of contacts 191 are electrically unconnected to the battery pack 271 and the third and fourth contacts 236 and 238 of the plurality of contacts 231 in the socket well 233 are electrically unconnected to the battery charging circuit 261.

In operation, the battery charge circuit 261 is connected to an appropriate alternating current source of electrical power. Whether the rechargeable battery portion 19 is or is not connected to the battery charge circuit 261, i.e., the rechargeable battery portion 19 is or is not in the socket well 223, both timers IC1 and IC3 are initialized. As long as timer IC3 is operating, the charge circuit 261 is in the battery discharge mode. That is, switch FET1 is closed so that current is being conducted from the power supply circuit 573 through resistor diodes D8, D9 and D10. Timer IC3 is configured to run for 15 seconds without the rechargeable battery portion 19 connected to the battery charge circuit 261. After the 15 second time period has elapsed, timer IC3 turns off and timer IC2 is initialized to begin a short boost charge period. In this operating state, i.e., without the rechargeable battery portion 19 connected to the battery charge circuit 261, timer IC2 is configured to operate for a 45 second period. After the end of the 45 second period, the boost charge function is turned off and the trickle charge, controlled by timer IC1, continues for the 30 seconds remaining in the operating period of timer IC1. At the end of the 30 second period, both the discharge timer IC3 and the boost charge timer IC2 are configured to run for one hour and three hours, respectively.

When the rechargeable battery portion 19 is connected to the battery charge circuit 261, the batteries 213 are trickle charged, i.e., charged slowly using a relatively low current flow, at a rate determined by resistor R3 of the power supply circuit 573. When the switch S is depressed by the user of the appliance, discharge timer IC3 is turned on for a period of one hour thereby closing switch FET1 to cause discharge of the remaining power in the batteries 213 in the rechargeable battery portion 19 through resistor R6 diodes D8, D9 and D10 and switch FET1. Serially connected diodes D8, D9 and D10 prevent the batteries 213 in the rechargeable battery portion 19 from being discharged too low. Draining the individual batteries 213 in the rechargeable battery portion 19 too low could cause reversal of one of the individual batteries 213. When several batteries are connected in series, batteries with a higher capacity may cause a reversal of the polarity of the weaker batteries during battery discharge. The series connected diodes D8, D9 and D10 prevent any reversal in the polarity of the batteries 213 in the rechargeable battery portion 19 during discharge of the rechargeable battery portion 19.

The rechargeable battery portion 19 can be discharged, in response to manual actuation of the switch S, before the beginning of the charge cycle in order to eliminate any adverse memory effect on the rechargeable battery portion 19. Whenever the battery charge circuit 261 is in the discharge mode, visual indicator LED1 turns on to indicate that discharge is taking place.

When the one hour discharge period for discharge timer IC3 expires, boost charge timer IC2 is automatically started for a period of three hours. The boost charge circuit generates a high current source for charging the battery quickly for a three hour period. When the three hour boost charge timer period expires, the boost charge circuit 359 turns off and the battery charge circuit 261 continues to trickle charge the rechargeable battery portion 19 at a rate determined by resistor R3. The trickle charge rate runs continuously for as long as the rechargeable battery portion 19 is connected to the battery charge circuit 261.

Whenever the battery charge circuit 261 is in the charge mode, either in the boost charge operating mode or in the trickle charge operating mode, visual indicator LED2 is turned on by the voltage drop that occurs when the rechargeable battery portion 19 is connected to the battery charge circuit 261.

Figure 16:
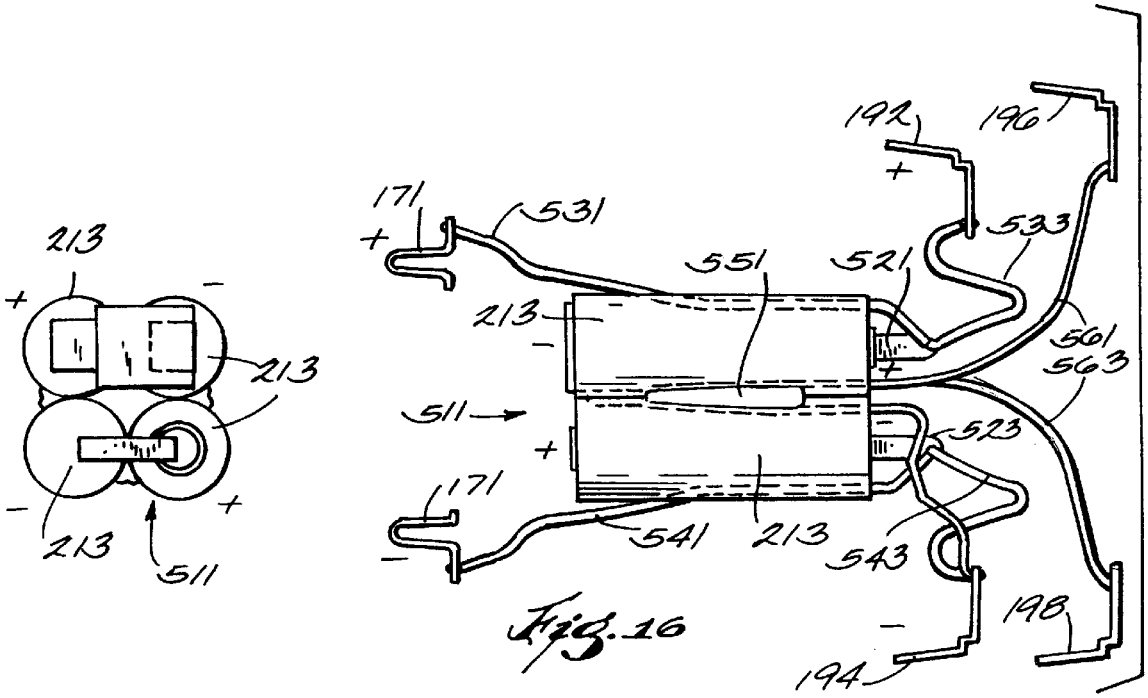
FIG. 16 is a exploded elevational view of a second embodiment of a battery assembly which can be included in the hair clipper shown in FIG. 2.
Figure 17:
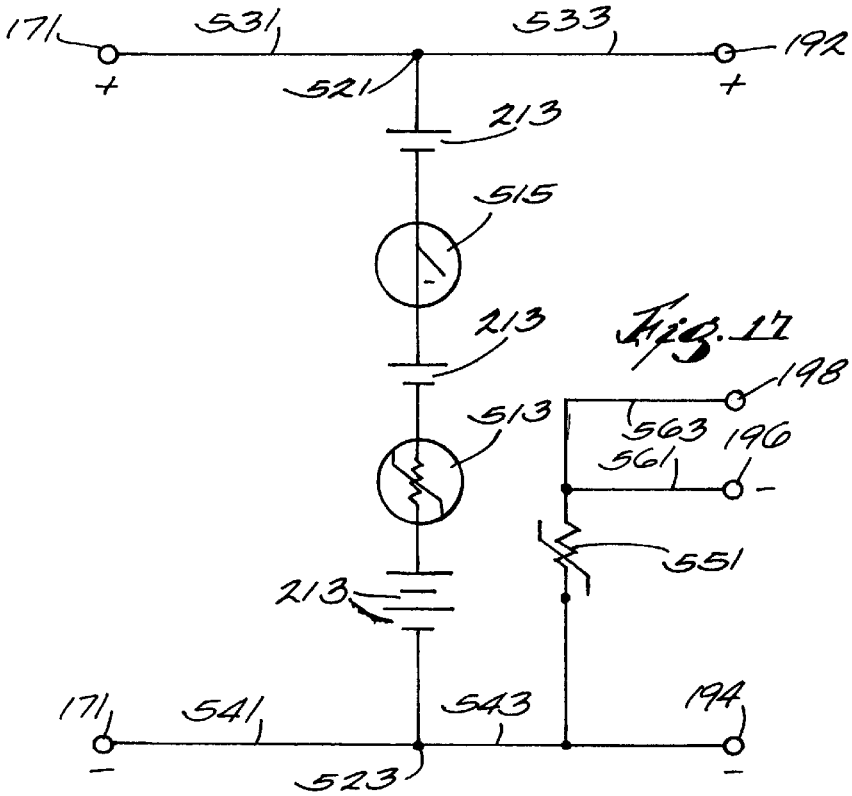
FIG. 17 is a wiring diagram for the battery assembly shown in FIG. 16.
Figure 18:
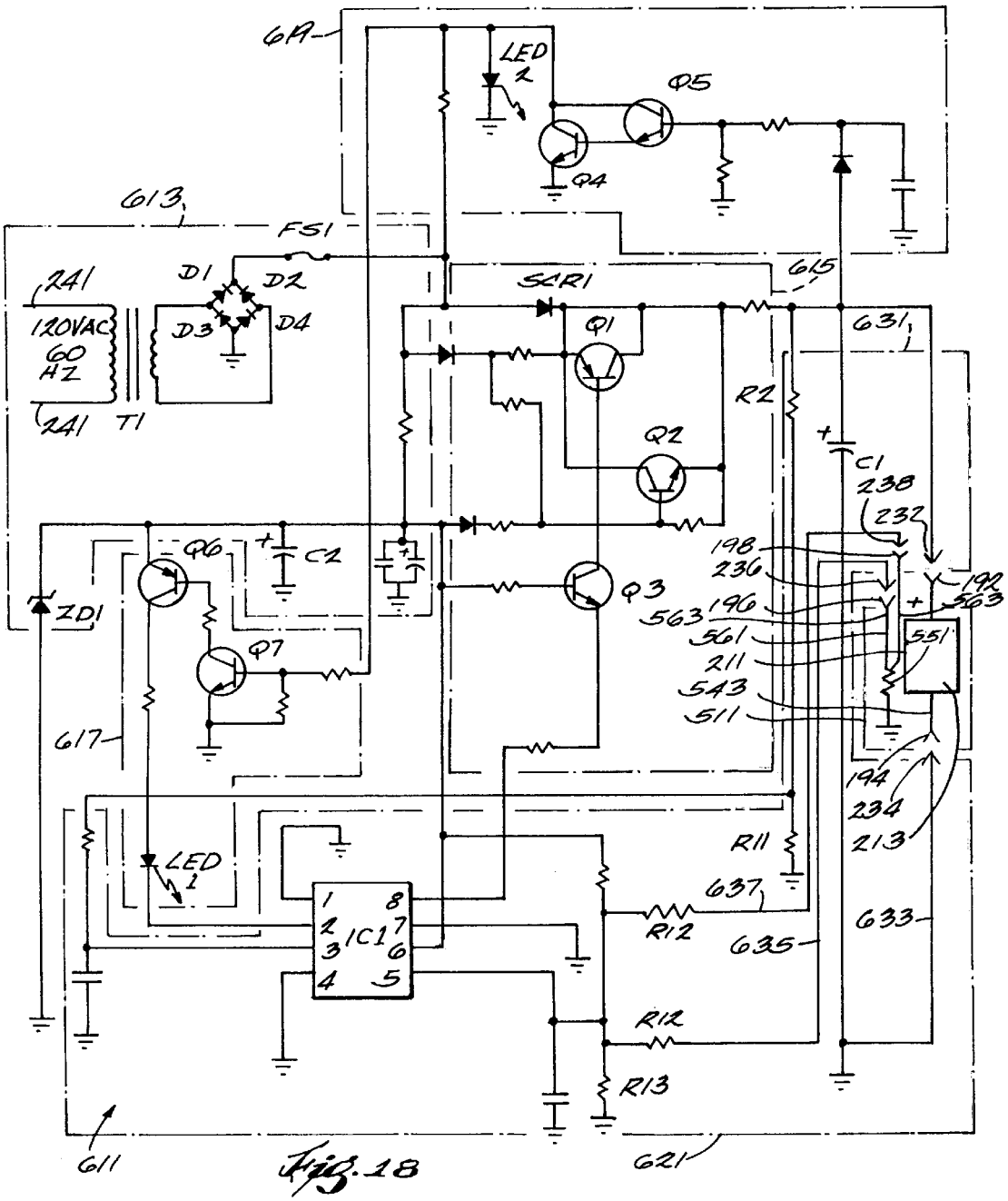
FIG. 18 is a wiring diagram illustrating one embodiment of a circuit which is employed with the battery assembly referred to in FIGS. 16 and 17.

In another particular embodiment, as shown in FIGS. 16, 17 and 18, the battery assembly 211 includes (see FIGS. 16 and 17) four batteries 213 which are nestled together in a battery pack 511 to provide a compact assembly, which are connected together, in any suitable manner, in series with one another and with a suitable polyswitch 513 and with a thermostat 515, and which are connected to a positive terminal 521 and to a negative terminal 523. In addition, the battery pack 511 also includes, at one end of the battery pack 511, a first lead 531 which is connected between the positive terminal 521 and one of the pair of electrical terminals 171 extending from the inner end portion 163 of the rechargeable battery portion 19, and a second lead 533 which extends from the positive terminal 521 to the first contact 192 of the plurality of contacts 191 on the outer end portion 181 of the rechargeable battery portion 19, which first contact 192 engages the first contact 232 of the plurality of contacts 231 in the socket well 223 of the battery charger 15 when the rechargeable battery portion 19 is in the socket well 223 of the battery charger 15.

The battery pack 511 also includes a third lead 541 which is connected between the negative terminal 523 and the other one of the pair of electrical terminals 171 extending from the inner end portion 163 of the rechargeable battery portion 19, and a fourth lead 543 which extends from the negative terminal 523 to the second contact 194 of the plurality of contacts 191 on the rechargeable battery portion 19, which second contact 194 engages the second contact 234 of the plurality of contacts 231 in the socket well 223 of the battery charger 15 when the rechargeable battery portion 19 is in the socket well 223 of the battery charger 15.

Still further in addition, the battery pack 511 includes a thermistor 551 which is nestled together with the four batteries 213 in the battery pack 511, which extends from a point in adjacent relation to the other end of the battery pack 511, and which is connected by a fifth lead 561 to the third contact 196 of the plurality of contacts 191 on the outer end portion 181 of the rechargeable battery portion 19, which third contact 196 engages the third contact 236 of the plurality of contacts 231 in the socket well 223 of the battery charger 15 when the rechargeable battery portion 19 is in the socket well 223 of the battery charger 15.

If desired to provide superior reliability, the thermistor 551 can also be connected by a sixth lead 563 which extends in parallel to the fifth lead 561 and which is connected to the fourth contact 198 of the plurality of contacts 191 on the outer end portion 181 of the rechargeable battery portion 19, which fourth contact 198 engages the fourth contact 238 of the plurality of contacts 231 in the socket well 223 of the battery charger 15 when the rechargeable battery portion 19 is in the socket well 223 of the battery charger 15.

Alternatively, if desired, the sixth lead 563 can be omitted, and when omitted, the fourth contact 198 of the plurality of contacts 191 on the outer end portion 181 of the rechargeable battery portion 19 is electrically unconnected within the rechargeable battery portion 19 and the fourth contact 238 of the plurality of contacts 231 in the socket well 223 is electrically unconnected within the battery charger 15.

The embodiment of FIGS. 16, 17, and 18 also includes, as shown in FIG. 18, a battery charge circuit 611 including a power supply circuit 613, a power switch circuit 615, a pair of indicator circuits 617 and 619, and a charge control circuit 621.

The power supply circuit 613 is adapted to be connected to a source of electrical power which, in the embodiment shown in FIG. 18, is a 120 volt, 60 Hz source of alternating current. The power supply circuit 613 includes a power transformer T1 connected to a full-wave bridge rectifier including diodes D1, D2, D3 and D4 in a wheatstone bridge configuration. The bridge rectifier is connected to capacitor C2, C4, and C7 via fuse FS1. Capacitors C2, C4 and C7 filter and smooth the rectified waveform to provide a 5 volt direct current (d.c.) source of power for the battery charge control circuit 621. The power supply circuit 613 also includes zener diode ZD1 which operates as a shunt regulator to "bleed off" any voltage above the 5 volt level.

The power switch circuit 615 selectively connects the rechargeable battery portion 19 to the power supply circuit 613 so as to charge the battery pack or assembly 511. The power switch circuit 615 also includes a silicon controlled rectifier SCR1, and transistor switches Q1, Q2 and Q3 for providing a gate signal to switch off SCR1.

The charge control circuit 621 is connected to the power supply circuit 613 and to the power switch circuit 615. The charge control circuit 621 includes applicable electrical contacts which connect the battery charge circuit 621 to the rechargeable battery portion 19 when the rechargeable battery portion 19 is located in the socket well 223 of the battery charger 15. More specifically, the charge control circuit 621 includes a first lead 631 which is connected to the first contact 232 of the plurality of contacts 231 in the socket well 223, which first contact 232 engages the first contact 192 of the plurality of contacts 191 on the outer end portion 181 of the rechargeable battery portion 19 when the rechargeable battery portion 19 is in the socket well 223 of the battery charger 15. The charge control circuit 621 also includes and a second lead 633 which is connected to the second contact 234 of the plurality of contacts 231 in the socket well 223, which second contact 234 engages the second contact 194 of the plurality of contacts 191 on the outer end portion 181 of the rechargeable battery portion 19 when the rechargeable battery portion 19 is in the socket well 223 of the battery charger 15.

In addition, the charge control circuit 621 also includes another lead 635 which is connected to the third contact 236 of the plurality of contacts 231 in the socket well 223, which third contact 236 engages the third contact 196 of the plurality of contacts 191 on the outer end portion 181 of the rechargeable battery portion 19 when the rechargeable battery portion 19 is in the socket well 223 of the battery charger 15.

Still further in addition, when the thermistor 551 is connected to the sixth lead 563, the charge control circuit 621 also includes still another lead 637 which extends in parallel to the lead 635 and which is connected to the fourth contact 238 of the plurality of contacts 231 in the socket well 223, which fourth contact 238 engages the fourth contact 198 of the plurality of contacts 191 on the outer end portion 181 of the rechargeable battery portion 19 when the rechargeable battery portion 19 is in the socket well 223 of the battery charger 15.

When the sixth lead 563 (which extends from the thermistor 551) is omitted, the fourth contact 238 of the plurality of contacts 231 in the socket well 223 is electrically unconnected within the charger housing 221.

The charge control circuit 621 also includes a charge storage capacitor C1 which is connected in parallel relation to the electrical contacts 232 and 234 so that, when the rechargeable battery portion 19 is connected to the battery charger circuit 261, the capacitor C1 is in parallel relation with the rechargeable battery portion 19.

The charge control circuit 621 also includes a resistor divider network consisting of resistors R2 and R11 is connected in parallel relation with the capacitor C1. The resistor divider network is connected to a charge control integrated circuit IC1. The charge control integrated circuit is, in the embodiment shown in the drawings, a BQ2002TPN Benchmarq integrated circuit. The charge control integrated circuit IC1 is connected to the power switch circuit 343 to provide a control signal for triggering switch SCR1.

The charge control circuit 621 also includes thermistor R14 which is also identified by the numeral 551 in FIGS. 16 and 17, which, as already noted, is a part of the battery pack 511, and which connects with the remainder of the charge control circuit 621 through the contacts 196 and 236 and lead 635, and via the resistor divider network formed by resistors R12 and R13 whenever the rechargeable battery portion 19 is placed in the socket well 223.

The indicator circuits 617 and 619 respectively include first or charging and second or discharging visual indicators LED1 and LED2. In the embodiment shown in FIG. 18, the first and second visual indicators LED1 and LED2 are light emitting diodes. However, any visual or audible indicator may be appropriate under various circumstances. As will be described in greater detail below, visual indicators LED1 and LED2 are lit to indicate the various operating states of the battery charge circuit 611. The visual indicators LED1 and LED2 are electrically driven by transistors Q6 and Q7, and Q4 and Q5, respectively. More particularly, the first visual indicator or charging indicator or light emitting diode LED1 is also identified by the numeral 573 in FIG. 1, is mounted on the charger housing 221 adjacent the socket well 223, is preferably of one color, such as green, and is illuminated during battery charging. The second visual indicator or discharging indicator or light emitting diode LED2 is also identified by the numeral 575 in FIG. 1, is mounted on the charger housing 221 adjacent the charging indicator 573, is preferably of another color, such as red, and is illuminated during battery charging.

In operation, with the battery charge circuit 611 connected to an appropriate alternating current source of electrical power, and before the rechargeable battery portion 19 is connected to the battery charge circuit 611, a peak DC voltage is stored on capacitor C1. This peak DC voltage allows the charge control circuit 621 to detect when the rechargeable battery portion 19 has been connected to the battery charge circuit 611. When the rechargeable battery portion 19 is placed in the socket well 223 and thereby is connected to the battery charge circuit 611, the voltage stored on capacitor C1 drops as the charge is transferred to the battery pack or assembly 211. The decrease in voltage on capacitor C1 is sensed by the resistive divider network consisting of R2 and R11 and this voltage is transmitted to charge control integrated circuit IC1. In response, charge control integrated circuit IC1 outputs a signal to turn on switch SCR1 thereby placing the battery charge circuit 611 in the fast charge mode. In the fast charge mode, switch SCR1 is on 100% or all of the time. For a completely discharged battery, the battery charge circuit 611 will remain in the fast charge mode for about 1 hour.

Toward the end of the fast charge cycle, the temperature of the batteries 213 in the battery pack or assembly 511 increases and the resistance value of R14 (as discussed above, a thermistor internal to the battery pack or assembly 511) decreases. The resistor divider network of resistors R12 and R13 establishes a voltage which is transferred to charge control integrated circuit IC1. When this voltage decreases by a predetermined amount, the fast charge mode is terminated by charge control integrated circuit IC1 and a top-off charge continues for approximately 30 minutes after the end of the fast charge mode. During the top-off charge mode, charge control integrated circuit IC1 triggers switch SCR1 so that it sequentially turns on and off in order to provide a pulsed current flow to charge the rechargeable battery portion 19.

After the end of the top-off charge mode period, charge control integrated circuit IC1 reduces the frequency at which switch SCR1 is triggered during what is called a maintenance charge mode. Whenever current is flowing to the batteries 213, i.e., whenever the rechargeable battery portion 19 is in the socket well 223, indicator LED1 is lit to indicate that current is flowing to the battery pack or assembly 211. Also, whenever the battery charge circuit 261 is in the fast charge mode, indicator LED2 is lit.

In use, when the clipper portion 17 and the rechargeable battery portion 19 are assembled with the electrical terminals 131 of the clipper portion 17 in electrical connection with the electrical terminals 171 of the rechargeable battery portion 19, the hair clipper 13 can be used by an operator in the normal fashion. After use, when the batteries 213 in the rechargeable battery portion 19 lose their charge, the rechargeable battery portion 19 of the assembled hair clipper 13 can be located in the socket well 223 of the battery charger 15 so as to electrically connect the electrical contacts 191 on the outer cylindrical surface 185 of the outer end portion 181 of the rechargeable battery portion 19 with the electrical contacts 231 located on the cylindrical wall 227 of the socket well 223 of the battery charger 15.

In addition, should the batteries 213 in the battery assembly 211 become non-functional by reason of no longer being capable of receiving a further charge, the non-functional rechargeable battery portion 19 can be replaced by depressing the locking segment 67 of the locking ring 61 and by withdrawing the non-functioning battery portion 19 from the battery socket 35 and by inserting a new rechargeable battery portion 19. The new rechargeable battery portion 19 can be inserted in the battery socket 35 and electrical connection made between the electrical terminals 131 of the clipper portion 17 and the electrical terminals 171 of the rechargeable battery portion 19 in response to depression of the locking segment 67 of the locking ring 61 so as to align the bore of the locking or ring portion 63 with the opening or aperture 55 in the flange 51 of the rear end portion 33 of the clipper portion 17. When such electrical connection is made, the locking ring 61 can be manually released so as to enable locking movement thereof, under the influence of the spring 64, into the locking groove 167 in the inner end portion 163 of the rechargeable battery portion 19.

After a period of use, when the rechargeable battery portion 19 becomes spent or discharged, the spent or discharged rechargeable battery portion 19 can be located in the socket well 223 of the battery charger 15 either when the spent or discharged rechargeable battery portion 19 is assembled with the clipper portion 17 or when the spent or discharged rechargeable battery portion 19 is disassembled from the clipper portion 17. Thus in use, when the spent or discharged rechargeable battery portion 19 requires recharging, the spent or discharged rechargeable battery portion 19 can be removed from the clipper portion 17 and located in the socket well 223 of the battery charger 15 for recharging, and another charged rechargeable battery portion 19 assembled with the clipper portion 17 so that the operator can continue to use the clipper portion 17 when the spent or discharged rechargeable battery portion 19 is being recharged.

Various of the features are set forth in the following claims.

What is claimed is:

1. An appliance assembly comprising an appliance portion including an elongated appliance housing including a rear end portion including a rechargeable battery socket with a transverse base wall having therein a circular aperture, and an interior wall extending from said base wall in the direction of elongation of said appliance housing and having therein a keyway groove extending in the direction of elongation of said appliance housing, a frame fixedly supported within said appliance housing, an electrical motor fixedly supported on said frame within said appliance housing, a pair of electrical terminals fixedly supported on said frame and in spaced relation to each other, and an electrical switch supported by said appliance housing and operatively connected between said electrical terminals and said electrical motor, and a rechargeable battery portion including a sealed housing having an inner end portion removably insertable into said battery socket of said rear end portion of said appliance housing and including a pair of electrical terminals fixed in spaced relation to each other and in engagement with said pair of electrical terminals of said appliance portion when said inner end portion of said sealed housing of said rechargeable battery portion is located in said battery socket, an outer end portion including an end surface, an outer surface extending from said end surface in the direction of insertion of said rechargeable battery portion and having therein a keyway slot extending in the direction of insertion of said rechargeable battery portion, and a plurality of electrical contacts on said outer end portion and in a predetermined spaced relation to one another, and an intermediate portion located between said inner end portion and said outer end portion and having an outer surface including a key extending in the direction of insertion of said battery portion and removably receivable in said keyway groove in said interior wall of said battery socket of said rear end portion of said appliance housing, and a battery assembly located in said sealed housing and electrically connected between said pair of electrical terminals of said inner end portion of said rechargeable battery portion and to less than all of said plurality of electrical contacts of said outer end portion of said rechargeable battery portion, and a battery charger including a charger housing including a socket well removably receiving said outer end portion of said rechargeable battery portion and having a generally horizontally extending base wall, and a generally vertical wall extending from said base wall of said socket well, a vertically extending rib extending from said vertical wall and inwardly into said socket well and in engagement with said keyway slot of said outer surface of said outer end portion of said rechargeable battery portion when said outer end portion of said rechargeable battery portion is received in said socket well of said charger housing of said battery charger, a plurality of electrical contacts located on said vertically extending wall in said socket well in a predetermined relation to one another which is the same as said predetermined relation of said plurality of contacts of said outer end portion of said rechargeable battery portion and in respective engagement with said plurality of contacts of said outer end portion of said rechargeable battery portion when said rechargeable battery portion is located in said socket well, an electrical cord extending from said charger housing and being adapted to be connected to a source of electrical current, and a circuit board located within said charger housing and including a circuit electrically connected to said electrical cord and to less than all of said plurality of contacts located on said vertically extending wall of said socket well of said battery charger.

2. An appliance assembly in accordance with claim 1 wherein said appliance housing includes an outer surface an interior annular groove located in axially adjacently spaced relation from said base wall, and an opening communicating between said annular groove and said outer surface of said appliance housing, a locking ring movably located in said annular groove and including a ring portion defining a bore and including a locking segment, and an operating portion located in diametrically opposed relation from said locking segment and extending radially from said ring portion through said opening communicating between said annular groove and said outer surface of said appliance housing, and a spring located in said annular groove and biasing said locking ring to normally locate said locking segment inwardly beyond the bore of said circular aperture in a locking position and to normally locate said operating portion in outwardly projecting relation to said outer surface and to permit displacement of said locking ring so as to depress said operating portion relative to said outwardly projecting relation and so as to displace said locking segment from said locking position and into a release position clear of said circular aperture, and wherein said rechargeable battery portion includes a flange having a periphery, and an annular locking groove located axially inwardly from said flange and being lockingly engaged by said locking segment of said locking ring when said inner end portion of said sealed housing of said rechargeable battery portion is located in said battery socket of said rear end portion of said appliance housing of said appliance portion, and when said locking ring is in said locking position.

3. An appliance assembly in accordance with claim 1 wherein only two of said plurality of contacts located in said socket well are electrically connected to said circuit, and wherein the other of said plurality of contacts located in said socket well are electrically unconnected to said circuit.

4. An appliance assembly in accordance with claim 1 wherein only two of said plurality of contacts on said outer end portion of said rechargeable battery portion are electrically connected to said battery assembly, and wherein the other of said plurality of contacts on said outer end portion of said rechargeable battery portion are electrically unconnected to said battery assembly.

5. An appliance assembly in accordance with claim 1 wherein said battery assembly includes three series connected batteries.

6. An appliance assembly in accordance with claim 1 wherein said charger housing includes a charge indicating light which is illuminated during charging of said battery assembly.

7. An appliance assembly in accordance with claim 1 wherein said charger housing includes a discharge indicating light which is illuminated during discharging of said battery assembly.

8. An appliance assembly in accordance with claim 1 wherein said circuit board includes a circuit including a charging sub-circuit including a charge indicating light which is illuminated during charging of said battery assembly, and a discharge indicating light which is illuminated during discharging of said battery assembly.

9. An appliance assembly in accordance with claim 1 wherein said rechargeable battery portion includes a thermistor, and wherein said circuit includes a power switch circuit, a circuit network for generating a voltage indicative of the voltage of said rechargeable battery portion, a timer connected to said power switch circuit and for generating a control signal to selectively switch said power switch circuit and thereby connect said rechargeable battery portion to the source of electrical current in response to the voltage and wherein said timer is connected to said thermistor such that, when the temperature of said rechargeable battery portion exceeds a predetermined temperature, said timer sequentially connects and disconnects said rechargeable battery portion to the source of electrical current.

10. An appliance assembly in accordance with claim 1 wherein said circuit includes a discharge circuit adapted to be connected to said rechargeable battery portion, said discharge circuit including a current path for discharging current from said rechargeable battery portion and a plurality of diodes connected serially in said current path to prevent polarity reversal of said rechargeable battery portion; and a boost charge circuit for recharging said rechargeable battery portion with a high current for a predetermined period; and a timer circuit for recharging said rechargeable battery portion with a trickle current charge after expiration of said predetermined period.

11. An appliance assembly comprising a hand-held beauty appliance including an appliance portion including an elongated appliance housing including an outer surface, a rear end portion including a rechargeable battery socket with a transverse base wall having therein a circular aperture, and an interior wall extending from said base wall in the direction of elongation of said appliance housing and having therein a keyway groove extending in the direction of elongation of said appliance housing, an interior annular groove located in axially adjacently spaced relation from said base wall, and an opening communicating between said annular groove and said outer surface of said appliance housing, a locking ring located in said annular groove and including a ring portion defining a bore and including a locking segment, and an operating portion located in diametrically opposed relation from said locking segment and extending radially from said ring portion through said opening communicating between said annular groove and said outer surface of said appliance housing, a frame fixedly supported within said appliance housing, an electrical motor fixedly supported on said frame within said appliance housing, a pair of electrical terminals fixedly supported on said frame and extending in spaced relation to each other, an electrical switch supported by said appliance housing and operatively connected between said electrical terminals and said electrical motor, and a spring located in said annular groove and biasing said locking ring to normally locate said locking segment inwardly beyond the bore of said circular aperture in a locking position and to normally locate said operating portion in outwardly projecting relation to said outer surface and to permit displacement of said locking ring so as to depress said operating portion relative to said outwardly projecting relation and so as to displace said locking segment from said locking position and into a release position clear of said circular aperture, a rechargeable battery portion including a sealed housing having an inner end portion removably receivable in said battery socket of said rear end portion of said appliance housing and including a flange having a periphery, an annular locking groove located axially inwardly from said flange and being lockingly engaged by said locking segment of said locking ring when said inner end portion of said sealed housing of said rechargeable battery portion is located in said battery socket of said rear end portion of said appliance housing of said appliance portion, and when said locking ring is in said locking position, and a pair of electrical terminals located in fixed relation to each other and in engagement with said pair of electrical terminals on said frame when said inner end portion of said sealed housing of said rechargeable battery portion is located in said battery socket, an outer end portion including an end surface, an outer surface extending in the direction of insertion of said rechargeable battery portion and having therein a keyway slot extending in the direction of insertion of said rechargeable battery portion, and a plurality of electrical contacts located on said outer end portion and in spaced relation to one another, and an intermediate portion located between said inner end portion and said outer end portion and having an outer surface extending between said locking groove and said outer surface of said outer end portion and including a key extending in the direction of insertion of said rechargeable battery portion and being removably receivable in said keyway groove in said interior wall of said battery socket of said rear end portion of said appliance housing, and a battery assembly located in said sealed housing and electrically connected between said pair of electrical terminals of said inner end portion of said rechargeable battery portion and said plurality of contacts of said outer end portion of said rechargeable battery portion, and a battery charger including a charger housing including a socket well removably receiving said outer end portion of said rechargeable battery portion and having a generally horizontally extending base wall, and a generally vertical wall extending from said base wall of said socket well, a rib extending inwardly into said socket well and into removable engagement with said keyway slot of said outer surface of said outer end portion of said rechargeable battery portion when said outer end portion of said rechargeable battery portion is received in said socket well of said charger housing of said battery charger, a plurality of electrical contacts located in said socket well and in spaced relation to one another and in respective engagement with said plurality of contacts on said outer end portion of said rechargeable battery portion when said rechargeable battery portion is located in said socket well, an electrical cord extending from said charger housing and being adapted to be connected to a source of electrical current, and a circuit board located within said charger housing and including a circuit electrically connected between said electrical cord and said plurality of contacts in said socket well of said battery charger.

12. An appliance assembly in accordance with claim 11 wherein only two of said plurality of contacts located in said socket well are electrically connected to said circuit, and wherein the other of said plurality of contacts located in said socket well are electrically unconnected to said circuit.

13. An appliance assembly in accordance with claim 11 wherein only two of said plurality of contacts on said outer end portion of said rechargeable battery portion are electrically connected to said battery assembly, and wherein the other of said plurality of contacts on said outer end portion of said rechargeable battery portion are electrically unconnected to said battery assembly.

14. An appliance assembly in accordance with claim 13 wherein said circuit board includes a circuit including a charging sub-circuit including a charge indicating light which is illuminated during charging of said battery assembly, and a discharge indicating light which is illuminated during discharging of said battery assembly.

15. An appliance assembly in accordance with claim 11 wherein said battery assembly includes three series connected batteries.

16. An appliance assembly in accordance with claim 11 wherein said charger housing includes a charge indicating light which is illuminated during charging of said battery assembly.

17. An appliance assembly in accordance with claim 11 wherein said charger housing includes a discharge indicating light which is illuminated during discharging of said battery assembly.

18. A hair clipper assembly comprising a hair clipper including a clipper portion including an elongated clipper housing assembly including a first half-section, a second half-section mating with said first half-section, an outer surface, a rear end portion defined by said first and second half-sections and including a rechargeable battery socket of non-circular cross-sectional configuration and with a transverse base wall having therein a circular aperture, and an interior wall extending from said base wall in the direction of elongation of said clipper housing assembly and having therein a keyway groove extending in the direction of elongation of said clipper housing assembly, an interior annular groove located in axially adjacently spaced relation from said base wall, and an opening communicating between said annular groove and said outer surface of said first half-section of said clipper housing assembly, a front end portion, and an intermediate portion defining an interior cavity and including interior wall surfaces, a locking ring located in said annular groove and including a ring portion defining a bore and including a locking segment, and an operating portion located in diametrically opposed relation from said locking segment and extending radially from said ring portion through said opening communicating between said annular groove and said outer surface of said first half-section of said clipper housing assembly, a blade set carried by said front end portion of said clipper housing assembly, a frame fixedly supported within said clipper housing assembly by said interior wall surfaces, an electrical motor fixedly supported on said frame within said clipper housing assembly and drivingly connected to said blade set, a pair of electrical terminals fixedly supported on said frame and extending in spaced parallel relation to each other and through said circular aperture into said battery socket, an electrical switch supported by said first half-section of said clipper housing assembly and operatively connected between said electrical terminals and said electrical motor, and a spring biasing said locking ring so as to normally locate said operating portion in outwardly projecting relation to said outer surface, and so as to normally locate said locking segment inwardly within said circular aperture in a locking position, thereby permitting inward displacement of said operating portion from said outwardly projecting relation and displacement of said locking segment from said locking position and into a release position clear of said circular aperture, a rechargeable battery portion including a sealed housing having a battery assembly located in said sealed housing, a circular inner end portion removably receivable in said battery socket of said rear end portion of said clipper housing assembly of said hair clipper portion and including a flange defining an inner end of said inner end portion and having a periphery, an annular locking groove located axially inwardly from said flange and being lockingly engaged by said locking segment of said locking ring when said inner end portion of said sealed housing of said rechargeable battery portion is located in said battery socket of said rear end portion of said clipper housing assembly, and when said locking ring is in said locking position, and a pair of electrical terminals extending in spaced parallel relation to each other within the periphery of said flange, in electrical connection with said battery assembly, and in engagement with said pair of electrical terminals extending through said circular aperture into said battery socket when said inner end portion of said sealed housing of said rechargeable battery portion is located in said battery socket, an outer end portion including a dome-shaped end surface, an outer surface having a generally cylindrical cross-sectional configuration, extending from said dome-shaped end surface, and having therein an axially extending keyway slot, and four electrical contacts located adjacent said dome-shaped end surface and in a circular array in evenly spaced arcuate relation to one another and including two of said four contacts in electrical connection with said battery assembly and with said pair of electrical terminals extending within the periphery of said flange, and at least one of said four contacts being electrically unconnected, and an intermediate portion located between said inner end portion and said outer end portion and having an outer surface of non-circular cross-section corresponding to said noncircular cross-section of said socket of said rear end portion of said clipper housing assembly and extending from said locking groove and to said outer surface of said outer end portion of said rechargeable battery portion and including an axially extending key removably receivable in said keyway groove in said interior wall of said battery socket of said rear end portion of said clipper housing assembly of said hair clipper portion, and a battery charger including a charger housing including a socket well removably receiving said outer end portion of said rechargeable battery portion and having a generally horizontally extending base, and a generally vertically extending cylindrical wall having a generally cylindrical cross-sectional configuration corresponding to the cylindrical cross-sectional configuration of said outer surface of said outer end portion of said rechargeable battery portion, a vertically extending rib extending from said vertically extending cylindrical wall and inwardly into said socket well and in engagement with said axially extending keyway slot of said outer surface of said outer end portion of said rechargeable battery portion when said outer end portion of said rechargeable battery portion is received in said socket well of said charger housing of said battery charger, four electrical contacts located on said vertically extending cylindrical wall adjacent said base and in a circular array in evenly spaced arcuate relation to one another, in respective engagement with said plurality of contacts on said outer surface of said outer end portion of said rechargeable battery portion when said rechargeable battery portion is located in said socket well, and including at least one of said four contacts located on said vertically extending cylindrical wall being electrically unconnected, an electrical cord extending from said charger housing and being adapted to be connected to a source of electrical current, and a circuit board located within said charger housing and including a circuit electrically connected between said electrical cord and at least two of said four contacts located on said vertically extending cylindrical wall of said socket well of said battery charger.

19. A hair clipper assembly in accordance with claim 18 wherein said charger housing includes a charge indicating light which is illuminated during charging of said battery assembly.

20. A hair clipper assembly in accordance with claim 18 wherein said charger housing includes a discharge indicating light which is illuminated during discharging of said battery assembly.

21. A hair clipper assembly in accordance with claim 18 wherein said circuit board includes a circuit including a charging sub-circuit including a charge indicating light which is illuminated during charging of said battery assembly, and a discharge indicating light which is illuminated during discharging of said battery assembly.

* * * * *

UNITED STATES PATENT AND TRADEMARK OFFICE

CERTIFICATE OF CORRECTION

PATENT NO. : 6,112,414
DATED : September 5, 2000
INVENTOR(S) : Andis et al.

It is certified that error appears in the above-identified patent and that said Letters Patent is hereby corrected as shown below:

Column 10,
Line 47, delete "3" and insert "332"
Line 64, delete "236" and insert "336"
Line 64, Delete "238" and insert "338"

Column 11,
Line 30, delete "359" and insert "581"

Column 12,
Line 32, delete "261" and insert "571"

Column 13,
Line 10, delete "359"and insert "581"
Line 39, delete "223" and insert "233"
Line 51, delete "223" and insert "233"

Column 14,
Line 7, delete "563"
Line 44, delete "223" and insert "233"
Line 48, delete "223" and insert "229"

Column 17,
Line 3, delete "64" and insert "151"

Column 18,
Line 24, delete "an outer surface"

Signed and Sealed this

Fifteenth Day of January, 2002

*Attest:*

*Attesting Officer*

JAMES E. ROGAN
*Director of the United States Patent and Trademark Office*